US005797078A

United States Patent [19]

Sass et al.

[11] Patent Number: 5,797,078

[45] Date of Patent: Aug. 18, 1998

[54] PHOTORECEPTOR COMET PREVENTION BRUSH

[75] Inventors: Douglas W. Sass, Ontario; Stephen T. Dunn, Webster; Ronald E. Godlove, Bergen, all of N.Y.

[73] Assignee: Xerox Corporation, Stamford, Conn.

[21] Appl. No.: 88,146

[22] Filed: Jul. 9, 1993

[51] Int. Cl.[6] ..... G03G 21/00

[52] U.S. Cl. ..... 399/357; 399/353

[58] Field of Search ..... 355/296, 297, 355/301, 302, 215; 118/652; 399/343, 345, 353, 357

[56] References Cited

U.S. PATENT DOCUMENTS

| | | | |
|---|---|---|---|
| 3,918,808 | 11/1975 | Narita . | |
| 3,947,108 | 3/1976 | Thettu et al. . | |
| 4,230,406 | 10/1980 | Klett . | |
| 4,253,761 | 3/1981 | Takizawa et al. | 355/302 |
| 4,279,496 | 7/1981 | Silverberg . | |
| 4,364,660 | 12/1982 | Oda . | |
| 4,451,139 | 5/1984 | Yanagawa et al. . | |
| 4,499,849 | 2/1985 | Tomita et al. | 355/296 X |
| 4,835,807 | 6/1989 | Swift | 15/1.5 R |
| 4,875,081 | 10/1989 | Goffe et al. | 355/303 |
| 4,989,047 | 1/1991 | Jugle et al. | 355/297 |
| 5,083,169 | 1/1992 | Usui et al. | 355/296 |
| 5,111,251 | 5/1992 | Uno et al. | 355/297 |
| 5,175,591 | 12/1992 | Dunn et al. | 355/297 |
| 5,196,893 | 3/1993 | Nishise et al. | 355/296 X |

*Primary Examiner*—Sandra L. Brase

[57] ABSTRACT

An apparatus for cleaning a charge retentive surface of a photoreceptor which includes a rotating brush for cleaning the charge retentive surface of a photoreceptor. A spring or other device is used to maintain constant, uniformly distributed contact between the charge retentive surface and the rotating cleaning member together. The use of one or more pressure rollers to maintain the cleaning brush next to the photoreceptor belt can prevent undesirable friction, heat and/or static charge buildup adjacent to the photoreceptor, and can prevent photoreceptor jamming and other malfunctions. The resulting self regulating cleaning brush contact improves photoreceptor cleaning effectiveness despite brush aging, bristle wear or set, or other factors effecting the radius of the cleaning brush or its relative positioning in the photoreceptor cleaning assembly. The present invention results in the uniform distribution of the contact pressure on the photoreceptor, which may monitored and/or be controlled. A cleaning bar for dislodging debris that might otherwise remain attached to the rotating cleaning brush may also be biased towards and movable relative to the rotating brush.

2 Claims, 6 Drawing Sheets

FIG. 7
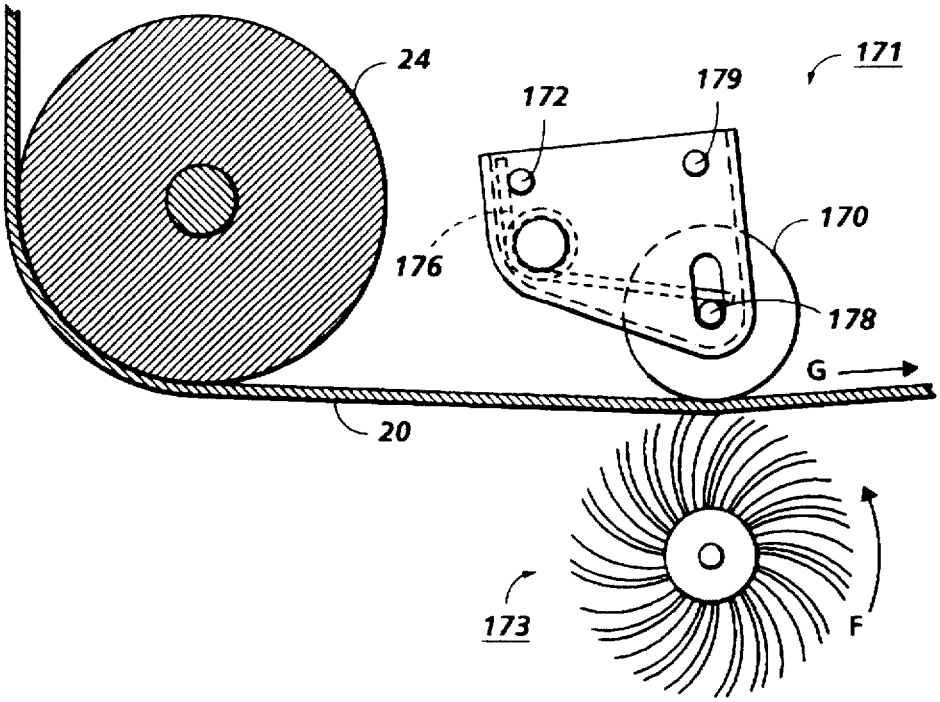
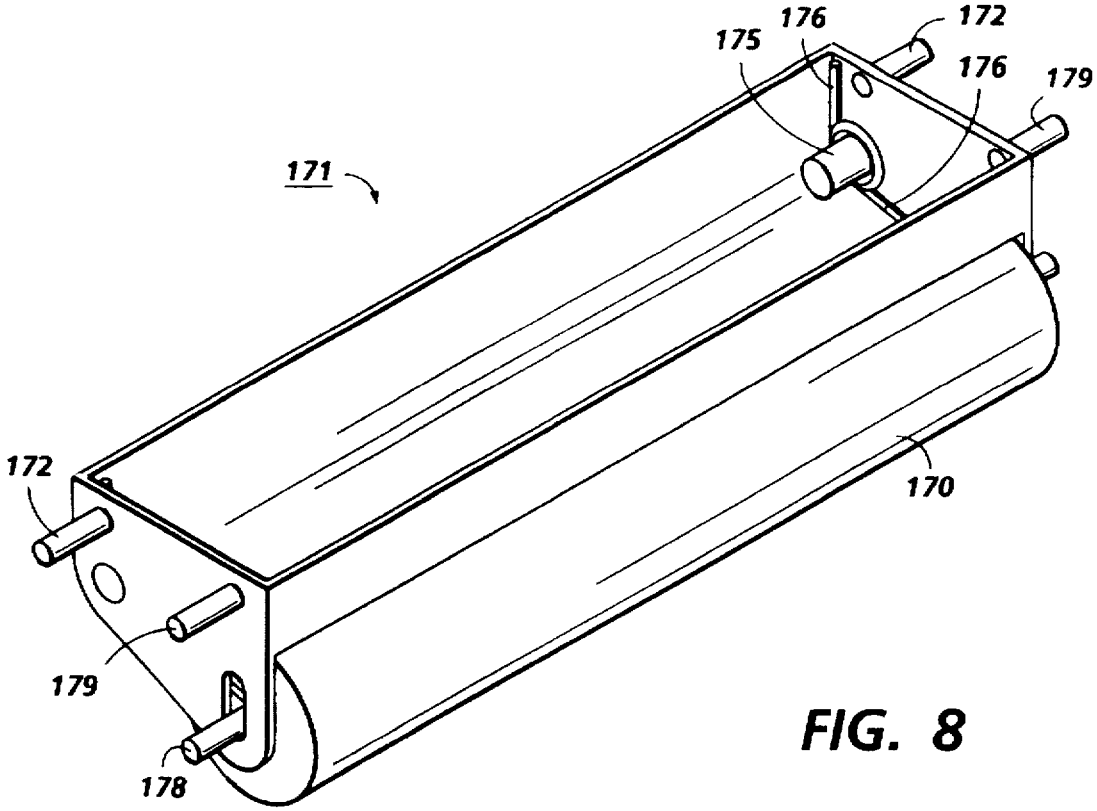
FIG. 8

PHOTORECEPTOR COMET PREVENTION BRUSH

The present invention relates to a electronic reprographic image forming apparatus, and more particularly to a cleaning device for cleaning residual toner and other debris from a charge retentive belt surface of an image forming apparatus.

In electrophotographic applications such as xerography, a charge retentive photoreceptor belt is electrostatically charged according to the image to be produced. In a digital printer, an input device such as a raster output scanner controlled by an electronic subsystem can be adapted to receive signals from a computer and to transpose these signals into suitable signals so as to record an electrostatic latent image corresponding to the document to be reproduced on the photoreceptor. In a digital copier, an input device such as a raster input scanner controlled by an electronic subsystem can be adapted to provide an electrostatic latent image to the photoreceptor. In a light lens copier, the photoreceptor may be exposed to a pattern of light or obtained from the original image to be reproduced. In each case, the resulting pattern of charged and discharged areas on photoreceptor form an electrostatic charge pattern (an electrostatic latent image) conforming to the original image.

The electrostatic image on the photoreceptor may be developed by contacting it with a finely divided electrostatically attractable toner. The toner is held in position on the photoreceptor image areas by the electrostatic charge on the surface. Thus, a toner image is produced in conformity with a light image of the original beam reproduced. Once each toner image is transferred to a substrate, and the image affixed thereto form a permanent record of the image to be reproduced. In the case of multicolor copiers and printers, the complexity of the image transfer process is compounded, as four or more colors of toner may be transferred to each substrate sheet. Once the single or multicolored toner is applied to the substrate, it is permanently affixed to the copy sheet by fusing so as to to create the single or multicolor copy or print.

Following the photoreceptor to substrate toner transfer process, it is necessary to at least periodically clean the charge retentive surface of the photoreceptor. In order to obtain the highest quality copy or print image, it is generally desirable to clean the photoreceptor each time toner is transferred to the substrate. In addition to removing excess or residual toner, other particles such as paper fibers, toner additives and other impurities (hereinafter collectively referred to as "residue") may remain on the charged surface of the photoreceptor. Cleaning blades and brushes may be employed to remove residue from a photoreceptor. An elastomeric blade may be used to scrape residue from the photoreceptor surface. A rotating cleaning brush may remove, loosen, dislodge, abrade or otherwise clean unwanted toner and other residue from the photoreceptor. When blades or brushes fail to prevent residue buildup on the photoreceptor, or otherwise fails to properly remove residue from the vicinity of the photoreceptor, a condition known as "cometing" may occur. The problem of cometing is generally manifested by the formation of spots on the copy or print sheet in background areas, greatly detracting from the quality of the final produced image.

Toner and residue removed as a result of the rotating brush and/or cleaning blade must then be transported away by a toner transport arrangement, by a vacuum, by gravity or by other means. Cleaning blades alone, or with an ineffective brush, may permit sealing gaps to leave residue behind on the photoreceptor. Similarly, friction, static charges or other forces may cause a buildup of residue on or near the blade and/or cleaning brush. The tip of the cleaning blade and brush bristles can also become bent due to photoreceptor belt movement and the high friction forces between them and the photoreceptor. Toner particles and residue may through heat, pressure or other forces, thereby may become temporarily or even permanently fused or attached to the photoreceptor, causing a variety of operational difficulties, to include poor copy quality. The problem may compound, as additional toner particles and residues continue to build up on the photoreceptor, the cleaning blade and/or the cleaning brush. Various approaches have been employed to clean the photoreceptor in a copying or printing machine, including the following disclosures that may be relevant:

U.S. Pat. No. 5,175,591
Patentee: Dunn et al.
Issued: Dec. 29, 1992

U.S. Pat. No. 4,989,047
Patentee: Jugle et al.
Issued: Jan. 29, 1991

U.S. Pat. No. 4,875,081
Patentee: Goffe et al.
Issued: Oct. 17, 1989

U.S. Pat. No. 4,835,807
Patentee: Swift
Issued: Jun. 6, 1989

U.S. Pat. No. 4,451,139
Patentee: Yanagawa etal.
Issued: May 29, 1984

U.S. Pat. No. 4,364,660
Patentee: Oda
Issued: Dec. 21, 1982

U.S. Pat. No. 4,279,496
Patentee: Silverberg
Issued: Jul. 21, 1981

U.S. Pat. No. 4,230,406
Patentee: Klett
Issued: Oct. 28, 1980

U.S. Pat. No. 3,947,108
Patentee: Thettu et al.
Issued: Mar. 30, 1976

U.S. Pat. No. 3,918,808
Patentee: Narita
Issued: Nov. 11, 1975

U.S. Pat. No. 5,175,591 to Dunn et al discloses a photoreceptor cleaning apparatus employing a rotating brush that cleans and/or abrades a photoreceptor upstream of a primary blade device for cleaning the photoreceptor.

U.S. Pat. No. 4,989,047 to Jugle et al discloses a photoreceptor cleaning apparatus for the reduction of spotting caused by agglomeration. A thin scraper member arranged at a low angle to the photoreceptor is provided as a secondary cleaning device to a rotating negatively biased fiber brush which contacts the surface of the photoreceptor upstream of the blade to remove most of the adhering toner particles. The rotating brush removes the preponderance of toner from the photoreceptor, and the blade removes any toner agglomerates formed on the photoreceptor by the agglomeration of toner, and toner and debris.

U.S. Pat. No. 4,364,660 to Oda discloses a photoreceptor cleaning system having a cleaning blade which removes toner from a photoreceptor. A fur brush located upstream of the cleaning blade acts as a toner recovery mechanism to recover toner removed from the photoreceptor by the cleaning blade. The brush is made from synthetic resin filaments having a diameter of 0.1 mm. The brush rotates in a direction opposite from the photoreceptor to direct toner toward the blade.

U.S. Pat. No. 4,279,496 to Silverberg discloses a belt supported by a fixed mounting and a movable mounting. The belt is deflected into the operative position by a expanded pneumatic bellows. A movable mounting may be used to deflect the belt into contact with a photoconductive belt surface. When the bellows is deflated into inoperative position (and the belt relaxes into a non-deflected position), the belt can be easily removed from the apparatus.

U.S. Pat. No. 4,230,406 to Klett discloses a photoreceptor cleaning apparatus which uses a pneumatic member to engage and disengage a cleaning roller with a photoconductive belt. When the photoconductive member moves, the bellows deflects the belt into contact with a cleaning roller; when the photoconductive belt is stationary, the bellows is deflates, returning the belt to a position spaced from the cleaning roller.

U.S. Pat. No. 4,451,139 to Yanagawa et al discloses a cleaning apparatus for a photoreceptor which includes an elastic polyurethane cleaning blade located downstream of a rotating fur brush with respect to the rotation direction of the photoreceptor.

U.S. Pat. No. 3,918,808 to Narita discloses a photoreceptor developing and cleaning station wherein a cleaning blade is placed in a developing station which uses a magnetic brush to apply toner to a photoreceptor. Two complete revolutions of a photoreceptor are required to perform a single copying operation. During a first revolution, the blade is retracted. After transfer of a toner image from the photoreceptor to a copy sheet, the blade is contacted with the photoreceptor to remove residual toner from the photoreceptor.

U.S. Pat. No. 3,947,108 to Thettu et al discloses a photoreceptor cleaning system wherein a blade acts as a primary cleaning member. A brush located downstream of the blade removes a residual film from the photoreceptor not removed by the blade. The brush is abrasive and made from cotton or plastic fibers.

U.S. Pat. No. 4,875,081 to Goffe et al discloses a blade member for cleaning a photoreceptor wherein an A.C. voltage is applied to the cleaning blade. Use of the A.C. voltage eliminates the need to bias the blade against the photoreceptor with a high frictional force and thus, eliminates impaction of toner on the photoreceptor surface.

U.S. Pat. No. 4,835,807 to Swift discloses a cleaning brush for an electrostatographic reproducing apparatus which has electroconductive fibers of nylon filamentary polymer substrate having finely divided electrically conductive particles of carbon black suffused therein.

The invention will be described in detail with reference to the following drawings, in which like reference numerals are used to refer to like elements. The various aspects of the present invention will become apparent as the following description proceeds and upon reference to the drawings, in which:

FIG. 7 is an elevational view, partially in section, of another embodiment of the present invention;

FIG. 8 is a perspective view showing further details of the pressure roller used in the photoreceptor cleaning apparatus shown in FIG. 7.

Figure 1:
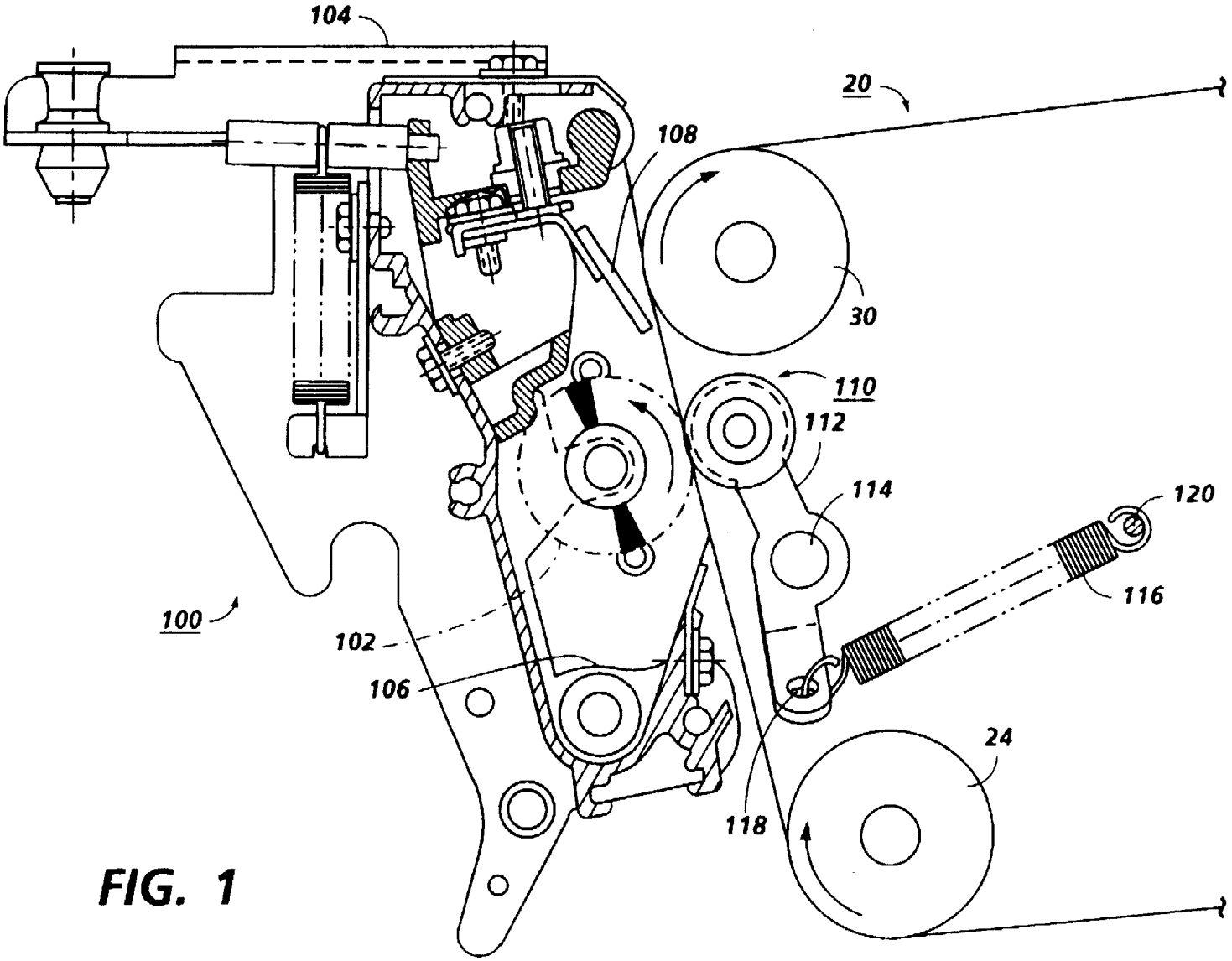
FIG. 1 is a sectional, elevational view of the pressure photoreceptor cleaning uniform brush assembly of the present invention.

While the present invention will hereinafter be described in connection with preferred embodiments, it will be understood that it is not intended to limit the invention to a particular embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate like elements. It will become evident from the following discussion that the present invention and the various embodiments set forth herein are suited for use in a wide variety of printing and copying systems, and are not necessarily limited in its application to the particular systems shown herein.

Figure 9:
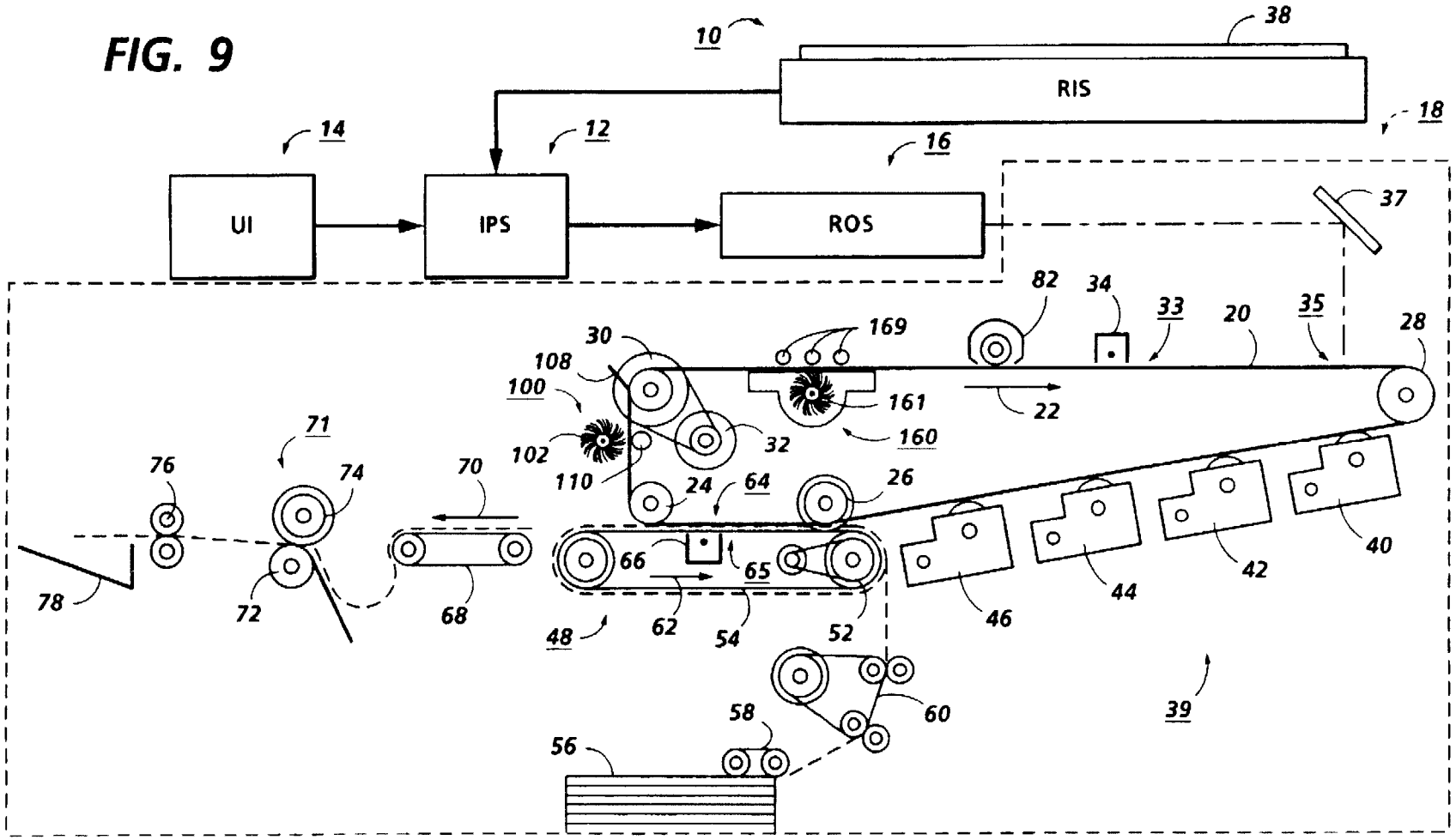
FIG. 9 is a schematic elevational view showing an exemplary electrophotographic printing machine which may incorporate the features of the present invention therein.

To begin by way of general explanation, FIG. 9 is a schematic elevational view showing an electrophotographic printing machine which may incorporate features of the present invention therein. It will become evident from the following discussion that the present invention is equally well suited for use in a wide variety of copying and printing systems, and is not necessarily limited in its application to the particular system shown herein. As shown in FIG. 9, during operation of the printing system, a multiple color original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of colorimetric coordinates.

The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt 20 of a printer or marking engine, indicated generally by the reference numeral 18, at a rate of about 400 pixels per inch, to achieve a set of subtractive primary latent images. The ROS will expose the photoconductive belt to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multicolored image on the copy sheet. This multicolored image is then fused to the copy sheet forming a color copy.

With continued reference to FIG. 9, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having multicolored original document 38 positioned thereat. The modulated light beam impinges on the surface of photoconductive belt 20. The beam illuminates the charged portion of the photoconductive belt to form an electrostatic latent image. The photoconductive belt is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface.

The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the nonoperative position, the magnetic brush is spaced therefrom. In FIG. 13, developer unit 40 is shown in the operative position with developer units 42, 44 and 46 being in the nonoperative position. During development of each electrostatic latent image, only one developer unit is in the operative position, the remaining developer units are in the nonoperative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper 84 (not shown in FIG. 9) extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 (not shown in FIG. 13) to sheet transport 48. Sheet 25 is advanced by transport 60 in synchronism with the movement of the sheet gripper. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. In transfer zone 64, a gas directing mechanism 100 directs a flow of gas onto sheet 25 to urge the sheet toward the developed toner image on photoconductive member 20 so as to enhance contact between the sheet and the developed toner image in the transfer zone. Further, in transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another.

One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multicolor copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

Figure 2:
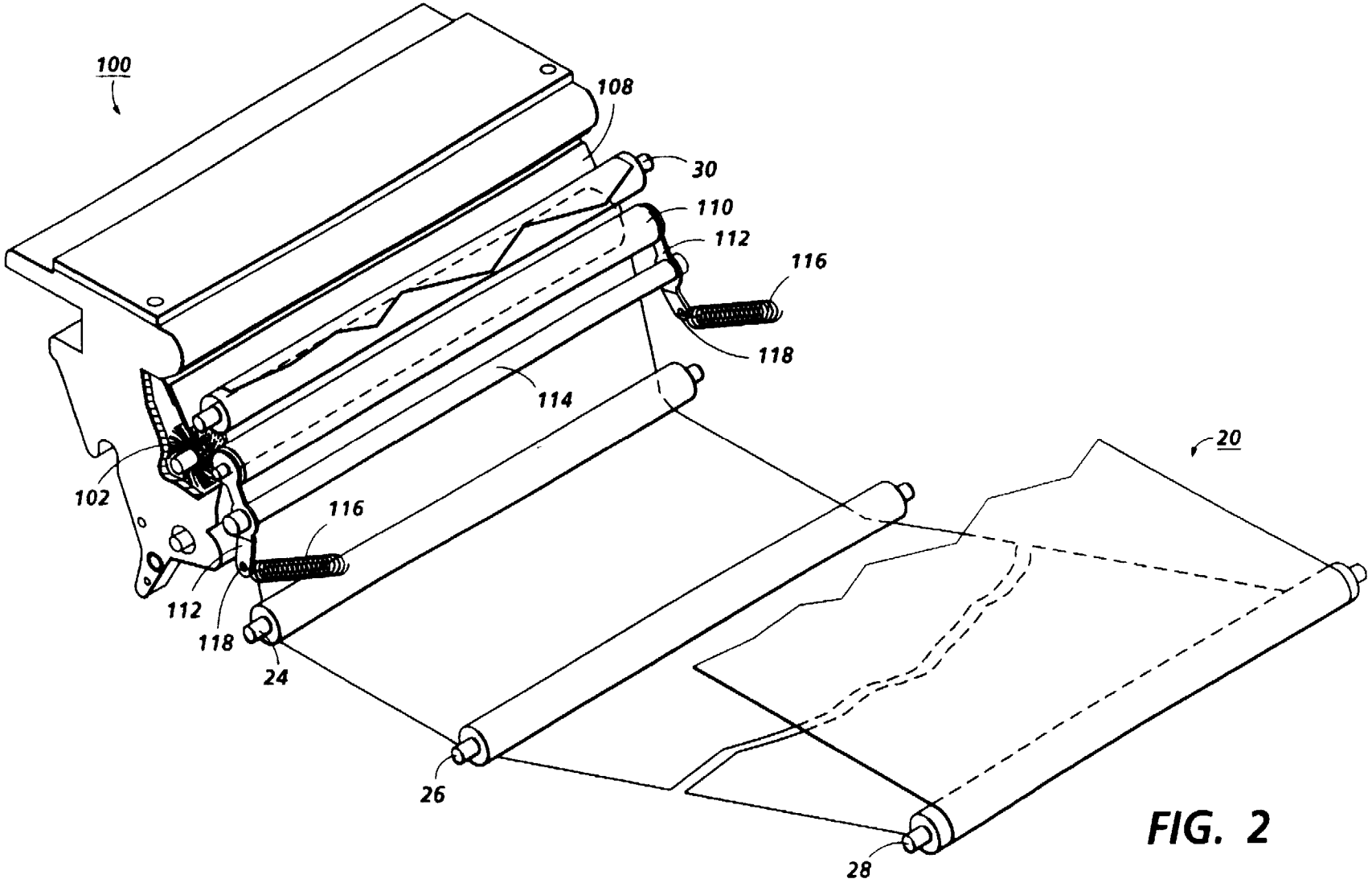
FIG. 2 is a perspective view, partially in section, of the photoreceptor cleaning brush assembly shown in FIG. 1.

The final processing station in the direction of movement of belt 20, as indicated by arrow 22, is a photoreceptor cleaning apparatus, indicated generally by the reference numeral 100, and as described in greater detail in association with FIGS. 1 and 2. A rotatably mounted fibrous brush 102 may be positioned in the cleaning station and maintained in contact with photoconductive belt 20 to remove residual toner particles remaining after the transfer operation. Pressure roller 110 insures that uniform pressure is exerted on photoreceptor by cleaning brush 102. Cleaning blade 108 may serve as the primary or backup means of toner and debris removal. In addition to or in place of photoreceptor cleaning apparatus 100, an overhead photoreceptor cleaning assembly indicated generally by the reference numeral 160 (and as described in greater detail in association with FIG. 6) is shown. Cleaning assembly 160 includes a cleaning brush 161 and support rollers 166, and may remove residual toner and debris from photoconductive belt 20 (Other aspects and embodiments of the photoreceptor cleaning apparatuses of the present invention, as shown and described in association with FIGS. 1–8, may likewise be employed in cleaning photoreceptors.) Thereafter, lamp 82 illuminates photoconductive belt 20 to remove any residual charge remaining thereon prior to the start of the next successive cycle.

FIG. 1 shows a photoreceptor cleaning apparatus 100 for removing residual toner and other debris from the charge retentive surface of photoreceptor 20, supported adjacent to photoreceptor 20 by mounting member 104. Photoreceptor cleaning apparatus 100 of the present invention provides for the application of a desired uniformly dispersed pressure or contact force by cleaning brush 102 on photoreceptor 20, such that the cleaning and/or abrading action of cleaning brush 102 on photoreceptor 20 may be constant, or may be increased or decreased according to the demands of the electrophotographic machine in which it is employed. Photoreceptor cleaning brush 102 may be coupled with an elastomeric cleaning blade 108 as shown in FIG. 1, for removing residual toner and other debris from the charge retentive surface. Cleaning brush 102 and cleaning blade 108 preferably extend across the width of photoreceptor 20, so as to cooperatively prevent cometing resulting from excess matter on the charge retentive surface. Cleaning blade 108 is mounted to supporting structure of photoreceptor cleaning apparatus 100. Photoreceptor 20 is held in place in part by drive roller 30 and tensioning roller 24 as shown in FIG. 1. Toner particles and debris removed from photoreceptor 20 by cleaning blade 108 and cleaning brush 102 may be collected in lower region 106 and/or otherwise be segregated from photoreceptor 20.

Cleaning brush 102 preferably includes a plurality of bristles, which must necessarily be constructed from a material that is softer than the charge retentive surface of photoreceptor 20 so to prevent excessive scratching or other damage to the charge retentive surface. The rotating cleaning brush 102 is located adjacent to the charge retentive surface of the photoreceptor belt; pressure roller 110 is located on the opposite side of the photoreceptor belt, so as to insure that the desired evenly distributed pressure is applied against photoreceptor 20 during the cleaning process. Unlike a system that might provide for a sliding or stationary backing or belt support member, the present invention uses one or more rollers rotatable in response to and in unison with the moving photoreceptor belt as the means to provide support opposite the cleaning brush. This use of freely rotating, frictionless pressure roller(s) 110 can reduce undesirable heating and static charging buildup (as well as associated particulate buildup) adjacent to the photoreceptor and can prevent photoreceptor jamming and other malfunctions. The curvature of the radius of the pressure roller(s) can desirably cause the bristles of cleaning brush 102 to concentrate their cleaning/abrading force over the small cross sectional area formed by the crown of photoreceptor belt 20 over the radius of pressure roller 110. Pressure roller 110 thereby presses photoreceptor belt 20 into the interior of the moving bristles of cleaning brush 102, insuring thorough photoreceptor cleaning. In this manner, as the force required for cleaning the charge retentive surface of the photoreceptor is more effectively applied to a photoreceptor passing over freely rotating pressure rollers, drag on continued movement of photoreceptor 20 is reduced, while the effectiveness and comet preventing ability of cleaning brush 102 is enhanced. Another important advantage of embodiments of the pressure roller(s) of the present invention lies in that their effect on the photoreceptor belt tensioning system that may be employed is slight or nonexistent. Deflection and/or modification of the photoreceptor belt path is minimized if not eliminated by the photoreceptor cleaning system of the present invention, which maintains cleaning brush 102 in constant uniform contact across the width of photoreceptor 20.

Cleaning brush 102 may be constructed by spirally wrapping a support sheet having a plurality of bundles of bristles, or by other means. Further, as the flexible bristles of cleaning brush 102 become worn over time, bristle shortening and set (caused by bristle bending contact against photoreceptor 20) may occur. Despite this bristle wear and/or set (and corresponding reduction in the radius of cleaning brush 102), the self adjusting springs 116 at both ends of pressure roller 110 maintain the positioning and uniform contact of cleaning brush 102 pressure along the cross sectional nip area of contact formed between the bristles of cleaning brush 102 and photoreceptor 20. Cleaning brush 102 may be rotated by the motors which rotate photoreceptor 20 via a gear linkage, or by a separate motor. Pressure roller 110 is biased toward photoreceptor 20 by springs 116, affixed to arms 112 at connection loops 118, at each end of pressure roller 110. Pins 120 hold the distant end of springs 116 in position; pivot axle 114 transfer the biasing force of springs 116 to support roller 110, so as to result in the desired uniformly distributed compressive force between cleaning brush 102 and photoreceptor 20, regardless of brush wear and other operating conditions.

Other positioning members, sensors and control systems may likewise be employed to bias pressure roller 110 is toward photoreceptor. One or more pneumatic, mechanical, screw, rack and pinion or other mechanisms (not shown) may be employed to urge the photoreceptor and the cleaning brush together, and to position pressure roller 110 against photoreceptor 20. Each means may be coupled with an operator and/or controller adjustable urging means, whereby the biasing force supplied (to pressure roller 110, the photoreceptor belt tensioning system (not shown) and/or the cleaning brush 102 are selectively or automatically adjusted so as to optimize photoreceptor cleaning performance. Variable pressure pistons and controlled fluid pumps (not shown) may be used in place of springs 116 as shown in FIG. 1 to provide the biasing force to pressure roller 110, and may operate using pneumatic pressure, mechanically variable spring force, or other means. The compressive force provided by pneumatic pressure pistons may also be selected by the operator, or may be controlled by an automatic microprocessor electronically coupled to an automatic electrophotographic copy quality monitoring system (not shown); one or more weights, elastomeric members, electromagnets and/or motors (not shown) may likewise be used to urge the cleaning brush and photoreceptor towards each other.

When a copy quality monitoring system (not shown) detects excess debris, toner residue or symptoms associated therewith following photoreceptor cleaning, the urging force provided by one or more pressure pistons (in place of spring 116, not shown) to pressure roller 110 may be automatically increased. Likewise, if a lesser biasing force to pressure roller 110 is desired (such as following the insertion of a new and increased diameter cleaning brush 102 or other condition), the automatic copy quality monitoring system could likewise adjust pressure piston so as to vary the biasing force supplied to pressure roller 110 so as to maximize cleaning effectiveness. One or more sensors and/or controllers (not shown) for monitoring/and/or adjusting the compression force between the cleaning brush and charge retentive surface of the photoreceptor may also be employed.

FIG. 2 shows a perspective view of photoreceptor 20, including photoreceptor cleaning apparatus 100 for removing residual toner and other debris. Drive roller 30 and tensioning rollers 24, 26 and 28 position photoreceptor 20; photoreceptor cleaning device 100 may includes cleaning blade 108 and cleaning brush 102, which extend across the width of photoreceptor 20. Cleaning brush 102 includes a plurality of bristles, which must necessarily be constructed from a material that is softer than the charge retentive surface so to prevent scratching. The rotating cleaning brush 102 is located adjacent to the charge retentive surface of the photoreceptor belt; support roller 110 is located on the opposite side of the photoreceptor belt, and is biased toward photoreceptor 20 by springs 116, affixed to arms 112 at connection loops 118. Pins 120 (not shown in FIG. 2) hold the distant end of springs 116 in position; pivot axle 114 transfers the biasing force of springs 116 to pressure roller 110, so as to result in a uniform distributed of pressure by cleaning brush 102 on photoreceptor 20. Again, the self adjusting nature of the apparatus of the present invention assures more reliable and effective photoreceptor cleaning.

Figure 3:
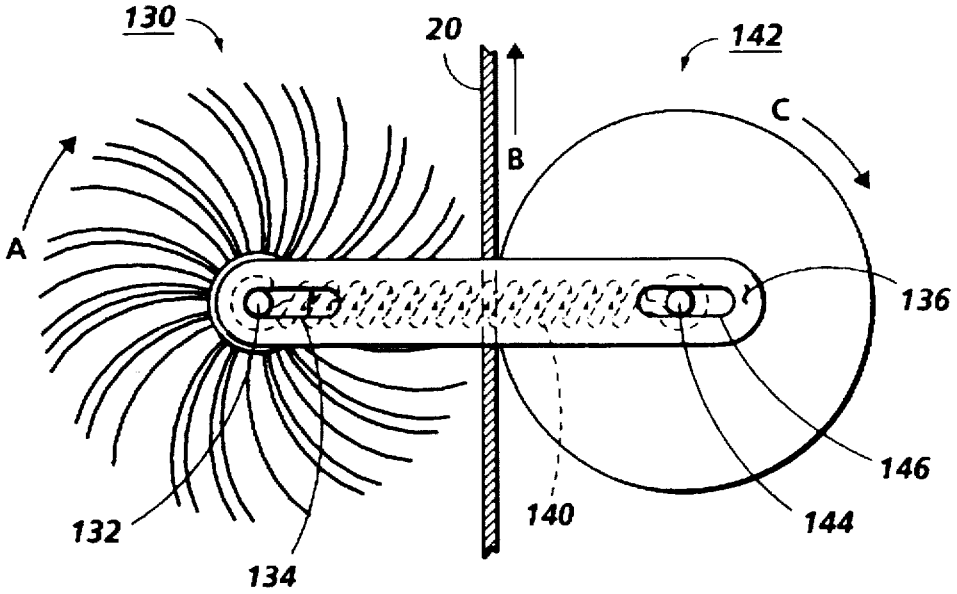
FIG. 3 is an elevational view, partially in section, of another embodiment of a photoreceptor cleaning brush assembly of the present invention.
Figure 4:
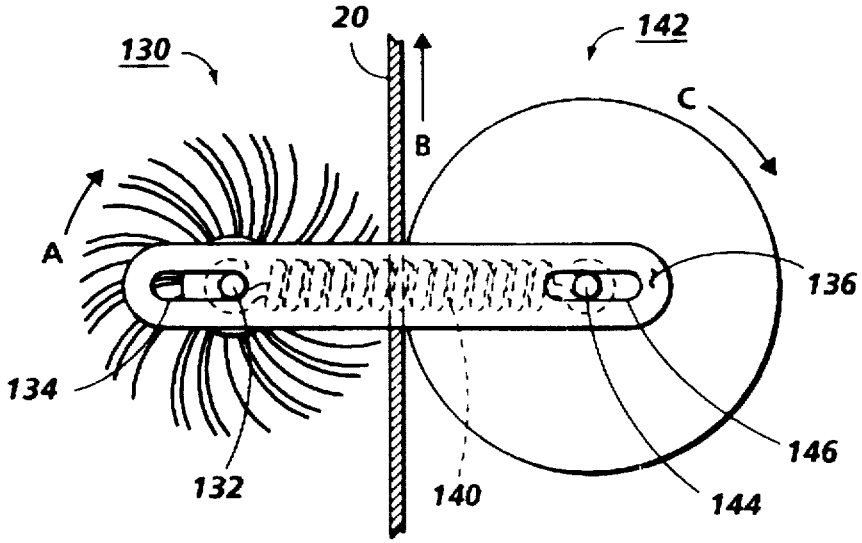
FIG. 4 is an elevational view, partially in section, of the embodiment of a photoreceptor cleaning brush assembly shown in FIG. 3.

FIG. 3 shows another embodiment of the photoreceptor cleaning brush of the present invention as may be positioned at virtually any point along photoreceptor belt 20. Cleaning brush 130 is shown in positioned adjacent to the charger to the surface of photoreceptor 20, biased towards photoreceptor 20 moving in direction B by spring 140. Photoreceptor cleaning brush 130 rotates on axle 132 in direction A, so as to clean and/or abrade photoreceptor 20 moving in an opposing direction. Photoreceptor cleaning brush 130 is permitted to slide in slot 134 towards photoreceptor 20 as the bristles of the photoreceptor brush 130 wear down. Pressure roller 142 rotates on axle 144 in direction C, and is also biased by spring 140 towards photoreceptor 20 permitted as it slides in slot 146. Frame member 136 provides the necessary support for both cleaning brush 130 and pressure roller 142. FIG. 4 shows photoreceptor cleaning brush 130 after the bristles of cleaning brush 130 have worn. Spring 140 as shown in FIGS. 3 and 4 provides a constant biasing force to ensure that photoreceptor cleaning brush 130 applies uniform pressure to the charge retentive surface of photoreceptor 20. When a rotating drum style photoreceptor is used (not shown) the drum itself may serve as the pressure roller so as to maintain the cleaning and/or abrading effectiveness of the rotating brush, as may be employed in the cleaning assembly embodiments shown in FIGS. 3–8.

Figure 5:
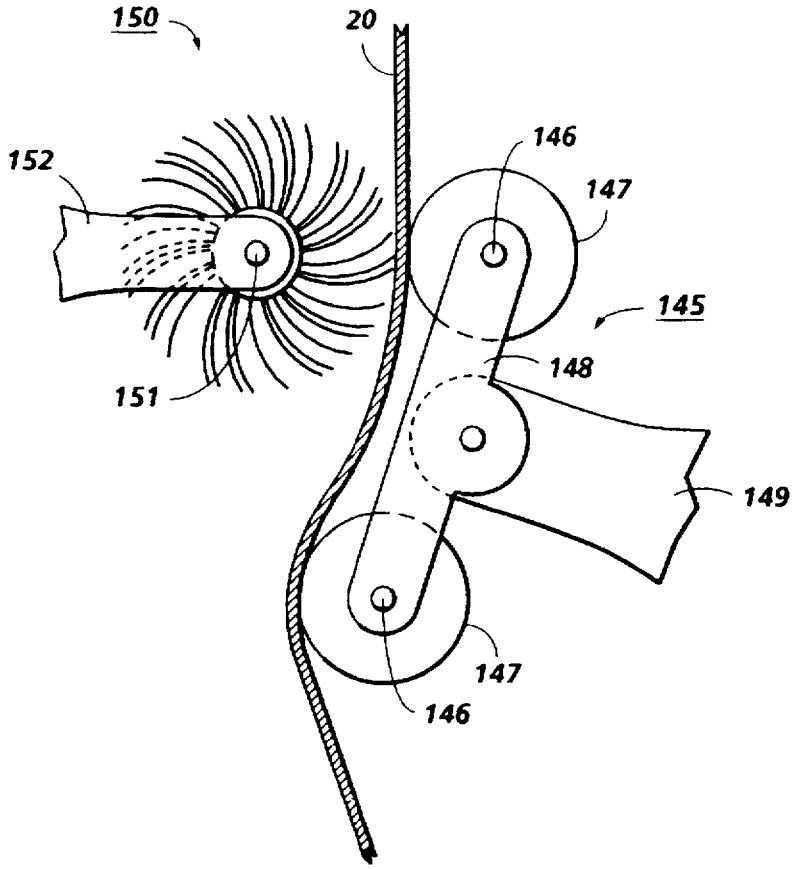
FIG. 5 is an elevational view, partially in section, of another embodiment of a photoreceptor cleaning cleaning brush station of the present invention.

With reference now to FIGS. 5, another embodiment of the uniform pressure photoreceptor cleaning brush of the present invention is shown A photoreceptor cleaning brush 150 is shown rotating on axle 151 and held in position adjacent to the charge retentive surface of photoreceptor 20 by support member 152. On the opposite side of photoreceptor 20 from cleaning brush 150 is found a pressure truck roller assembly 145 that ensures that cleaning brush 150 maintains a uniform cleaning pressure on photoreceptor 20 despite bristle wear or other factors. Rather than employing an adjacent spring or other local biasing means, pressure truck roller assembly 145 relies on the photoreceptor 20 belt tensioning mechanism (not shown) to maintain uniform pressure of cleaning brush 150 against photoreceptor 20. Support member 149 maintains cross member 148 adjacent to photoreceptor 20; as the diameter of cleaning brush 150 decreases due to wear, support rollers 147 adjust according to the photoreceptor belt tensioning mechanism to maintain uniform pressure by cleaning brush 150. Support rollers 147 rotate on axles 146, so as to adjustably maintain the position of photoreceptor brush 150 adjacent to the charge retentive surface of photoreceptor 20.

Figure 6:
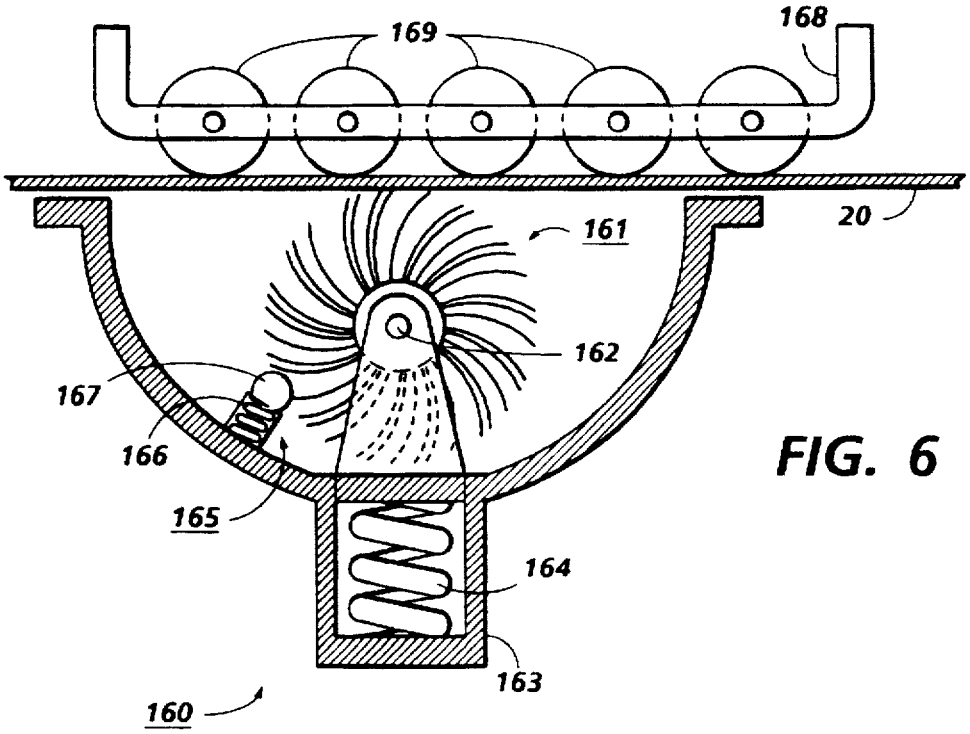
FIG. 6 is an elevational view, partially in section, of another embodiment of the present invention.

FIG. 6 shows another embodiment of the uniform pressure photoreceptor cleaning assembly of the present invention. Photoreceptor cleaning assembly 160 positions cleaning brush 161 adjacent to photoreceptor 20 by spring 164 positioned inside housing 163. Cleaning brush 161 rotates on axle 162, and is driven by an external motor (not shown). Photoreceptor 20 is held in position adjacent to cleaning brush 161 by support rollers 169, mounted on frame 168, so as to maintain uniform pressure during the photoreceptor cleaning operation. A single support roller 169 positioned directly opposite cleaning brush 161 may provide sufficient support to insure photoreceptor 20 is held in position. A cleaning blade (such as shown in FIG. 1) may also be positioned inside cleaning assembly 160 so as to assist in removing debris from the charge retentive surface of photoreceptor 20. Various systems (such as shown in FIGS. 1 and 2) may be employed to prevent debris removed from the photoreceptor from escaping. A brush cleaning bar assembly 165 may also be employed as shown in FIG. 6 or with the cleaning brushes shown in FIGS. 1–5 and 7–9, so as to prevent debris from collecting on cleaning brush 161. Brush cleaning bar assembly 165 dislodges matter that may adhere to cleaning brush 161. Cleaning bar 167 is biased towards cleaning brush 161 by spring 166, and is capable of maintaining contact with cleaning brush 161 despite bristle wear, set or other factors that may alter the radius and/or position of cleaning brush 161 over time.

With reference now to FIGS. 7 and 8, another embodiment of the present invention is depicted. Pressure roller 170 is mounted in bracket assembly 171. In the cutaway sectional view of photoreceptor 20 and support roller 24 as shown in FIG. 7, pressure is exerted by roller 170 so as to insure uniform cleaning is provided by photoreceptor cleaning brush 173 may be a function of gravity and spring bias force supplied by spring members 176 against axle 178 on which roller 170 rotates. Bracket assembly 171 is mounted on a pin sets 172 and 179; the support and/or force supplied by this mounting to the frame of the electrophotographic machine are modulated by spring 176 so as to provide a uniform and/or adjustable cleaning pressure against photoreceptor 20. The rotation of photoreceptor cleaning brush 173 in direction F by a motor (not shown) opposes the direction of movement G of photoreceptor 20 so as to effectuate the cleaning process. FIGS. 8 shows a view of the bracket assembly 171, in which pin sets 172 and 179; spring 176 is shown mounted inside bracket assembly 171 on retaining pins 175, permitting the desired biasing force to be transmitted to axle 178 of pressure roller 170.

In recapitulation, various embodiments of a drum or belt photoreceptor cleaning system employing a rotating cleaning brush which permits the removal of residual toner and debris from the charge retentive surface of a photoreceptor has been described.

While the present invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

We claim:

1. An apparatus for cleaning debris from a movable photoreceptor belt having an outer surface and an inner surface, comprising:

a rotatably mounted cleaning roller adapted to remove debris adhering to the outer surface of the photoreceptor belt;

a rotatably mounted pressure roller mounted adjacent to the inner surface of the photoreceptor belt, said cleaning roller and said pressure roller defining a nip through which the photoreceptor belt moves;

means for continuously maintaining a substantially uniformly distributed contact pressure between said cleaning roller and the outer surface of the photoreceptor belt; and a sensor for monitoring the contact pressure between said cleaning roller and the outer surface of the photoreceptor belt.

2. An apparatus for cleaning debris from a movable photoreceptor belt having an outer surface and an inner surface, comprising:

a rotatably mounted cleaning roller adapted to remove debris adhering to the outer surface of the photoreceptor belt;

a rotatably mounted pressure roller mounted adjacent to the inner surface of the photoreceptor belt, said cleaning roller and said pressure roller defining a nip through which the photoreceptor belt moves;

means for continuously maintaining a substantially uniformly distributed contact pressure between said cleaning roller and the outer surface of the photoreceptor belt; and a controller for varying the contact pressure between said cleaning roller and the outer surface of the photoreceptor belt.

* * * * *